US008985314B2

(12) United States Patent
Wang

(10) Patent No.: US 8,985,314 B2
(45) Date of Patent: Mar. 24, 2015

(54) DRIVEN ROLLER UNIT AND PAPER FEEDING DEVICE

(75) Inventor: Chih-Hwa Wang, New Taipei (TW)

(73) Assignees: Cal-Comp Electronics & Communications Company Limited, New Taipei (TW); Kinpo Electronics, Inc., New Taipei (TW)

( * ) Notice: Subject to any disclaimer, the term of this patent is extended or adjusted under 35 U.S.C. 154(b) by 0 days.

(21) Appl. No.: 13/525,364

(22) Filed: Jun. 18, 2012

(65) Prior Publication Data

US 2013/0153370 A1 Jun. 20, 2013

(30) Foreign Application Priority Data

Dec. 16, 2011 (TW) ..... 100146901 A

(51) Int. Cl.
*B65H 3/52* (2006.01)
*B65H 5/06* (2006.01)

(52) U.S. Cl.
CPC ..... *B65H 5/062* (2013.01); *B65H 2402/24* (2013.01); *B65H 2402/5152* (2013.01); *B65H 2402/5161* (2013.01); *B65H 2404/1431* (2013.01)
USPC ..... 198/780; 271/121

(58) Field of Classification Search
CPC ..... B65H 3/52; B65G 39/02
USPC ..... 198/780; 271/121
See application file for complete search history.

(56) References Cited

U.S. PATENT DOCUMENTS 4,601,775 A * 7/1986 Grone ..... 156/523
5,149,079 A * 9/1992 Iwamoto et al. ..... 271/162
6,032,951 A * 3/2000 Yamaguchi ..... 271/274
6,575,452 B2 * 6/2003 Hsiao et al. ..... 271/121
6,837,490 B2 * 1/2005 Hirai et al. ..... 271/148
7,295,222 B2 * 11/2007 Kim et al. ..... 347/171
7,355,763 B2 * 4/2008 Furihata ..... 358/474
8,403,252 B2 * 3/2013 Muir ..... 242/615.1
8,419,012 B2 * 4/2013 Otsuki ..... 271/145
2003/0102623 A1 6/2003 Hirai et al.
2008/0292375 A1 11/2008 Tsai et al.
2009/0152858 A1 * 6/2009 Legrand ..... 281/15.1
2011/0049795 A1 * 3/2011 Yamaguchi ..... 271/264
2011/0203471 A1 * 8/2011 Muir et al. ..... 101/481
2012/0033271 A1 * 2/2012 Olsen ..... 358/498

FOREIGN PATENT DOCUMENTS

CN 1712226 A 12/2005

OTHER PUBLICATIONS

"Office Action of China Counterpart Application", issued on Dec. 31, 2014, pp. 1-8, in which the listed references were cited.

* cited by examiner

*Primary Examiner* — Gene Crawford
*Assistant Examiner* — Thomas Randazzo
(74) *Attorney, Agent, or Firm* — Jianq Chyun IP Office

(57) ABSTRACT

A driven roller unit and a paper feeding device are provided. The paper feeding device includes a frame, the driven roller unit and a driving roller. The frame has a dome concave. The driven roller unit has an omnidirectional ball, wherein the omnidirectional ball is in the dome concave. The driving roller is disposed above the frame and the driven roller unit. When the driving roller presses on the driven roller unit, an angle included by the driving roller and the driven roller unit is adjusted due to the rotation of the omnidirectional ball relative to the dome concave, and therefore the force applied on the driven roller unit is uniform.

13 Claims, 7 Drawing Sheets

DRIVEN ROLLER UNIT AND PAPER FEEDING DEVICE

CROSS-REFERENCE TO RELATED APPLICATION

This application claims the priority benefit of Taiwan application serial no. 100146901, filed on Dec. 16, 2011. The entirety of the above-mentioned patent application is hereby incorporated by reference herein and made a part of this specification.

BACKGROUND OF THE INVENTION

1. Field of the Invention

The present invention relates to a driven roller unit and a paper feeding device, and more particularly relates to a driven roller unit capable to balance the force exerting thereon and a paper feeding device using the driven roller unit and capable to prevent paper from skewing.

2. Description of Related Art

FIG. 1 is a schematic view of a conventional paper feeding device. Referring to FIG. 1, the conventional paper feeding device 100 is adapted to be assembled on the base (not shown) of the multi-function printer and includes an driving roller 110, a driven roller 120 and a frame 130, wherein the frame 130 may be fixed on the base of the multi-function printer, and the frame 130 has a recess 132 with a shape corresponds with the driven roller 120, and the rod-shaped driven roller 120 is disposed in the recess 132 of the frame 130.

In general, the printed document may often skew due to the tilt of the paper during paper feeding process. The reason of paper skew is probably because a bad parallelism is formed between the driving roller 110 and the driven roller 120 of the paper feeding device 100, or because the pressure exerting from the driving roller 110 to the driven roller 120 is not uniformly distributed. It needs a mechanism to control the parallelism between the driving roller 110 and the driven roller 120. In other words, the assembly precision and tolerance of the components are required to be so good and thus the cost of components and human labor for assembling is further increased. In addition, so far in current technology, the parallelism between the driving roller 110 and the driven roller 120 cannot be automatically calibrated. Moreover, the crimp depth of the driving roller 110 exerting on the driven roller 120 cannot be precisely controlled by mechanism, and thus the problem of uneven distributed force exerting on the driven roller 120 has not been unable to be effectively improved.

SUMMARY OF THE INVENTION

The present invention provides a driven roller unit capable to balance the force exerting thereon.

The present invention also provides a paper feeding device capable to prevent paper from skewing.

The present invention provides a driven roller unit having an omnidirectional ball, and thus when the driven roller unit is pressed the omnidirectional ball rotates so as to balance the force acting on the driven roller unit.

According to an embodiment of the present invention, the driven roller unit includes a fixing support and a driven roller, wherein the omnidirectional ball is disposed below the fixing support, and the driven roller is disposed on the fixing support.

According to an embodiment of the present invention, the fixing support further has a pair of sidewalls and a base connected between the pair of sidewalls, and the omnidirectional ball is connected to the bottom of the base.

According to an embodiment of the present invention, the driven roller has an assembling shaft passing through the pair of sidewalls of the fixing support.

According to an embodiment of the present invention, each of the sidewalls has an assembling structure and the assembling shaft passes through the assembling structure.

According to an embodiment of the present invention, the assembling structures are openings disposed on the sidewalls along the altitudinal direction thereof.

According to an embodiment of the present invention, the driven roller unit further includes a pair of elastomers disposed within the openings.

According to an embodiment of the present invention, each of the sidewalls has at least one hollow portion so as to form an elastic structure.

According to an embodiment of the present invention, the driven roller has an assembling shaft passing through the fixing support.

The present invention further provides a paper feeding device including a frame, the driven roller unit mentioned above from any of the embodiments and a driving roller, wherein the driving roller is disposed above the driven roller and the frame and adapted to exert a force on the driven roller unit. The frame has a dome concave, and the omnidirectional ball of the driven roller is located in the dome concave.

According to an embodiment of the present invention, the frame further has a recess and the dome concave is disposed in the recess.

In light of the above, in the driven roller unit and the paper feeding device using the driven roller unit of the present invention, when the driving roller presses on the driven roller, the included angle formed between the driving roller and the driven roller is adjusted since the omnidirectional ball rotates relative to the dome concave, and therefore the force applied on the driven roller unit is uniform and the paper skew is prevented.

In order to make the aforementioned and other features and advantages of the invention more comprehensible, embodiments accompanying figures are described in detail below.

BRIEF DESCRIPTION OF THE DRAWINGS

The accompanying drawings constituting a part of this specification are incorporated herein to provide a further understanding of the invention. Here, the drawings illustrate embodiments of the invention and, together with the description, serve to explain the principles of the invention.

FIG. 4-1 is a schematic view of the paper feeding device according to FIG. 4 with the ball located in the dome concave being pressed by the driving roller.

DESCRIPTION OF EMBODIMENTS

Terminologies such as "up", "down", "left" and "right" are applicable to the embodiments shown and described in conjunction with the drawings. These terminologies are merely for the purposes of description and do not necessarily applied to the position or manner in which the invention may be constructed for actual use.

Figure 2:
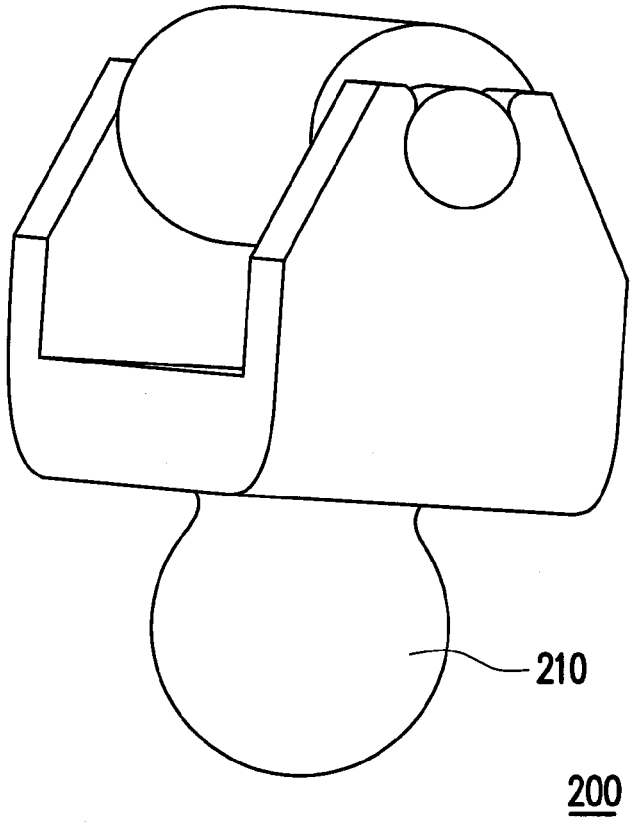
FIG. 2 is a schematic view of a driven roller unit according to the first embodiment of the present invention.

FIG. 2 is a schematic view of a driven roller unit according to the first embodiment of the present invention. Referring to FIG. 2, the driven roller unit 200 has an omnidirectional ball 210, wherein when the driven roller 200 is applied by a force, the omnidirectional ball 210 of the driven roller unit 200 may rotate so that the moment of the driven roller unit 200 is balanced and the force applied on the driven roller unit 200 is uniform. The driven roller unit 200 is applied to the paper feeding device 300 (shown in FIG. 4) of a multi-function printer is described as an exemplary embodiment as follows. However, people having ordinary skill in the art can apply the driven roller unit 200 to any other technical field in which the driven roller unit 200 capable to uniform the distributed force thereon is required, the present invention is not limited thereto.

Figure 4:
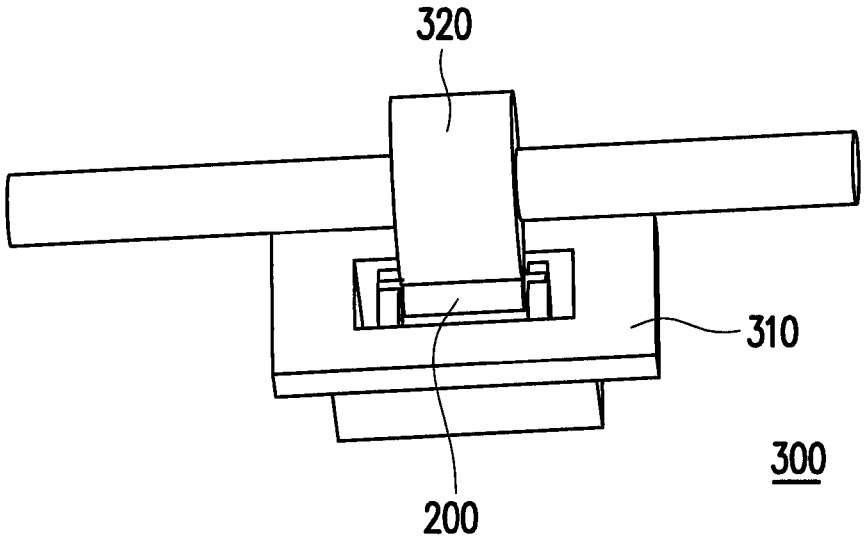
FIG. 4 is a schematic view of a paper feeding device according to an embodiment of the present invention.
Figures 1, 4:
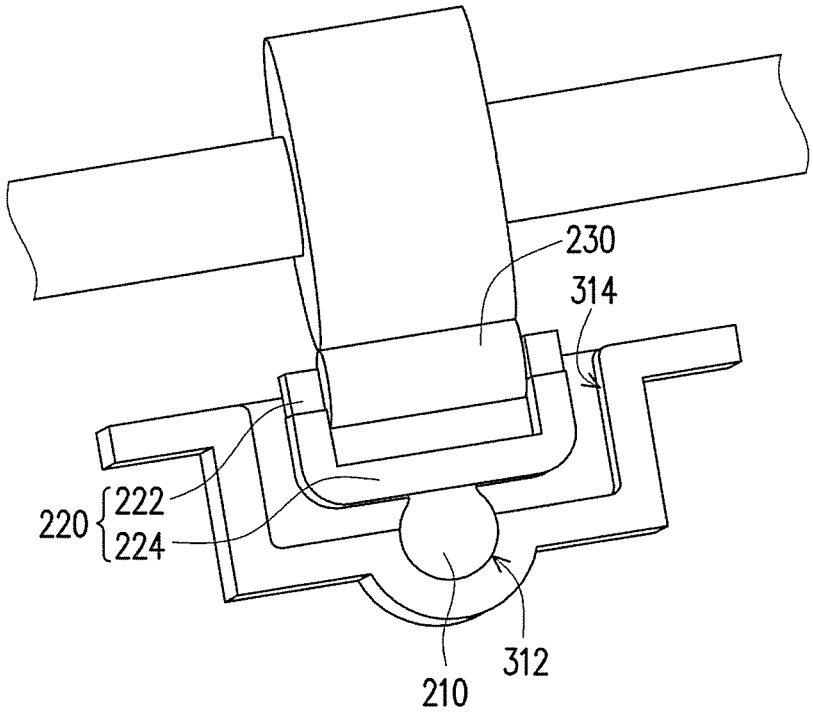

Accordingly, the paper feeding device 300 (as shown in FIG. 4) is disposed on the multi-function printer and used to feed documents into the body of the multi-function printer for printing, scanning or other process, and descriptions of other parts of the multi-function printer are omitted herein.

Figure 1:
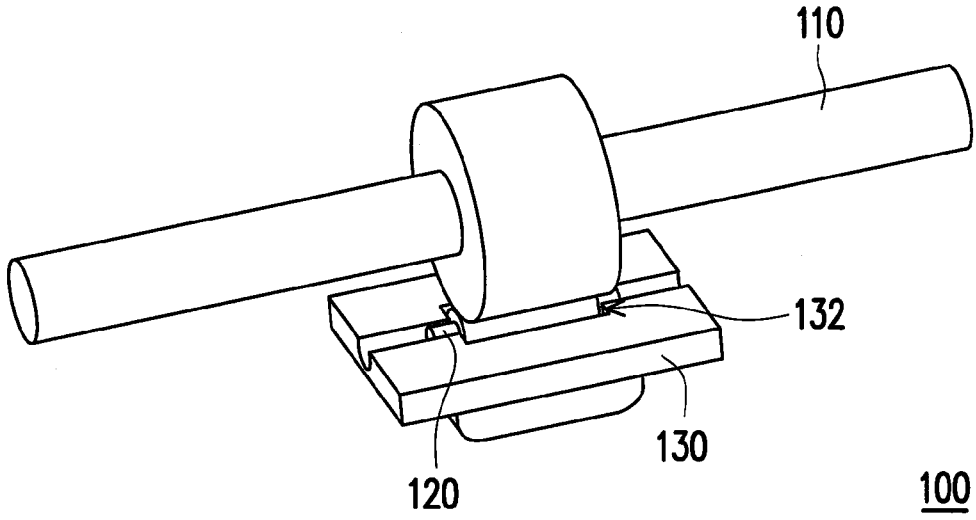
FIG. 1 (RELATED ART)
FIG. 1 is a schematic view of a conventional paper feeding device.
Figure 3:
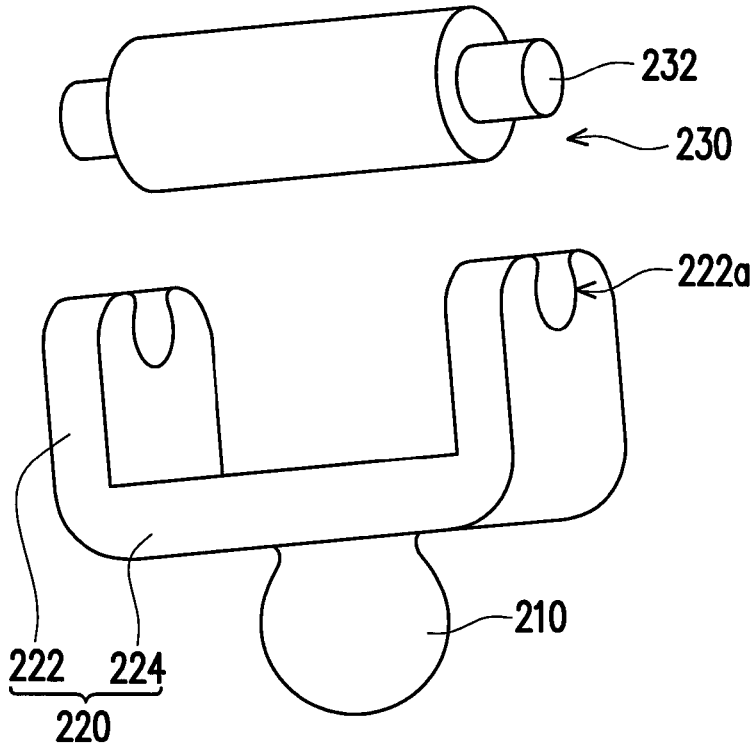
FIG. 3 is an exploded view of the driven roller unit of FIG. 2.
Figure 5:
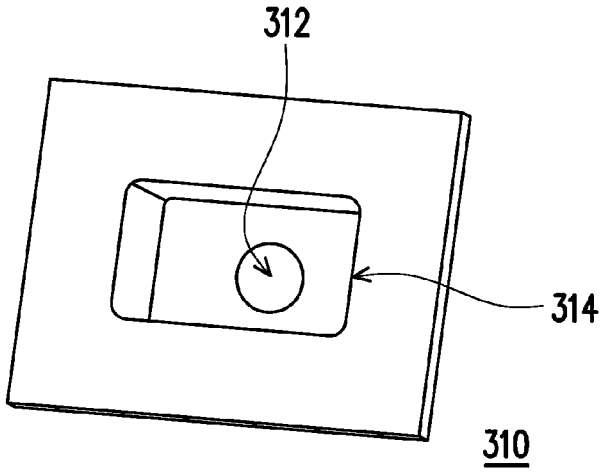
FIG. 5 is a schematic view of a frame of the paper feeding device of FIG. 4.

FIG. 3 is an exploded view of the driven roller unit of FIG. 2. FIG. 4 is a schematic view of a paper feeding device according to an embodiment of the present invention. FIG. 4-1 is a schematic view of the paper feeding device according to FIG. 4 with the ball located in the dome concave being pressed by the driving roller. Referring to FIG. 2, FIG. 3, FIG. 4, and FIG. 4-1 together, the paper feeding device 300 includes a frame 310, the driven roller unit 200 and a driving roller 320, wherein the driving roller 320 is disposed above the driven roller unit 200 and the frame 310 and adapted to exert force on the driven roller unit 200 so as to proceed to the paper feeding process. FIG. 5 is a schematic view of a frame of the paper feeding device of FIG. 4. Referring to FIG. 2, FIG. 4, FIG. 4-1 and FIG. 5 together, the frame 310 of the embodiment is fixed on the body of the multi-function printer and has a dome concave 312. And the omnidirectional ball 210 of the driven roller unit 200 is located in the dome concave 312.

In detailed, the driven roller unit 200 includes a fixing support 220 and a driven roller 230, wherein the omnidirectional ball 210 is disposed below the fixing support 220, and the driven roller 230 is disposed on the fixing support 220. More specifically, the fixing support 220 further has a pair of sidewalls 222 and a base 224 connected between the pair of sidewalls 222. The omnidirectional ball 210 is connected to the bottom of the base 224 and located at the center of the bottom of the base 224. In addition, the driven roller 230 has an assembling shaft 232 passing through the sidewalls 222 of the fixing support 220. And each of the sidewalls 222 has an assembling structure 222*a*, and the assembling shaft 232 is disposed to pass through the assembling structures 222*a* so that the driven roller 230 is assembled on the fixing support 220. In addition, a portion of the driven roller 230 used to contact with the driving roller 320 can be integrally formed with the assembling shaft 232, and the portion of the driven roller 230 used to contact with the driving roller 232 can be a sleeve sleeving the assembling shaft 232. And the material of the driven roller 230 can be selected according to the requirements, and the present invention is not limited thereto. The assembling structures 222*a* are openings disposed on the sidewalls 222 along the altitudinal direction thereof, wherein the depth of the opening can be shallow, or deep enough to be able to reach the base 224 of the sidewall 222.

In order to prevent the omnidirectional ball 210 being separated from the dome concave 312 and resulting in the driven roller unit 200 horizontally moving in a large range relative to the frame 310, the frame 310 can have a recess 314 and the dome concave 312 is disposed in the recess 314. The recess 314 is substantially in a rectangular shape, and the fixing support 220 of the driven roller unit 200 is accommodated in the recess 314.

Figure 6:
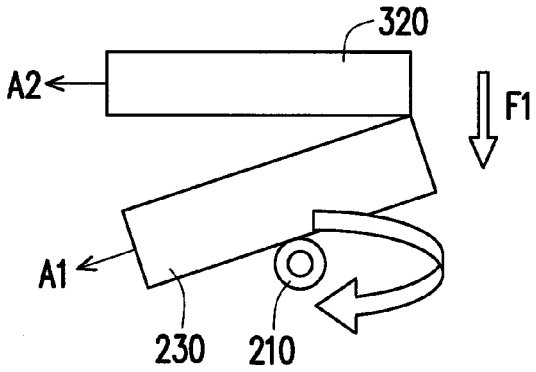
FIG. 6 and FIG. 7 are schematic views illustrating when the driven roller is pressed by the driving roller, the omnidirectional ball rotates so that the force applied on the driven roller unit is uniform relative to the driving roller.
Figure 7:
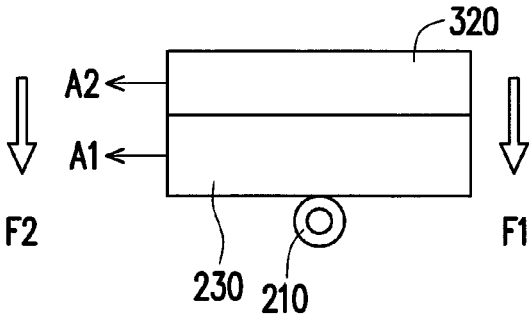

FIG. 6 and FIG. 7 are schematic views illustrating when the driven roller is pressed by the driving roller, the omnidirectional ball rotates so that the force applied on the driven roller unit is uniform relative to the driving roller. Referring to FIG. 5, FIG. 6 and FIG. 7 together, during the paper feeding process, the driving roller 320 approaches to the driven roller unit 200, and then the driving roller 320 presses the driven roller unit 200. More specifically, the driving roller 320 may contact with the driven roller 230 of the driven roller unit 200 first. And when the axis A1 of the driven roller 230 of the driven roller unit 200 (shown in FIG. 2) is not parallel to the axis A2 of the driving roller 320, the driving roller 320 may contact an end of the driven roller 230 and exerts a force F1 to that end.

In the meantime, the omnidirectional ball 210 located in the dome concave 312 may rotate relative to the dome concave 312, and the included angle between the driven roller 230 located on the fixing support 220 (shown in FIG. 3) and the driving roller 320 may further be adjusted to let the axis A1 of the driven roller 230 and the axis A2 of the driving roller 320 be parallel. Accordingly, the force applied by the driving roller 320 to the driven roller 230 is balanced to be uniform, i.e., the forces F1 and F2 respectively applied to the two opposite ends of the driven roller 230 are equal and the feeding paper is further prevented to be skewed.

The shape of the dome concave 312 is corresponding to that of the omnidirectional ball 210, and the size of the dome concave 312 is slightly greater than the size of the omnidirectional ball 210, in order to prevent a tight fit being formed between the omnidirectional ball 210 and the dome concave 312. If the omnidirectional ball 210 is tightly fitted to the dome concave 312, the driving force of the driving roller 320 exerting on the driven roller 230 has to be greater than the friction force between the omnidirectional ball 210 and the dome concave 312 so that the omnidirectional ball 210 can just rotate relative to the dome concave 312 and let the axis A1 of the driven roller 230 and the axis A2 of the driving roller 320 be parallel. In other words, in the embodiment, since the size of the dome concave 312 is slightly greater than the omnidirectional ball 210, under the condition of the force of the driving roller 320 exerting on the driven roller 230 capable to be comparatively smaller, the omnidirectional portion 210 can rotate relative to the dome concave 312.

In addition, since the size of the recess 314 of the frame 310 is slightly larger than the size of the fixing support 220 of the driven roller unit 200, and thus the recess 314 has a sufficient space to let the fixing support 220 rotate within the recess 314 due to the rotation of the omnidirectional ball 210 relative to the dome concave 312, and the fixing support 220 may not be interfered with the recess 314.

According to the descriptions mentioned above, since the driven roller unit 200 has the omnidirectional ball 210, when the force is applied to a specific point of the driven roller unit 200, the omnidirectional ball 210 can rotate relative to a datum plane propped against by the omnidirectional ball 210 and the driven roller unit 200 can further be adjusted, so that the axis A1 of the driven roller 230 of the driven roller unit 200 is parallel to the axis A2 of the driving roller 320, and thus the applied force exerting on the driven roller unit 200 is uniformly distributed.

Figure 8:
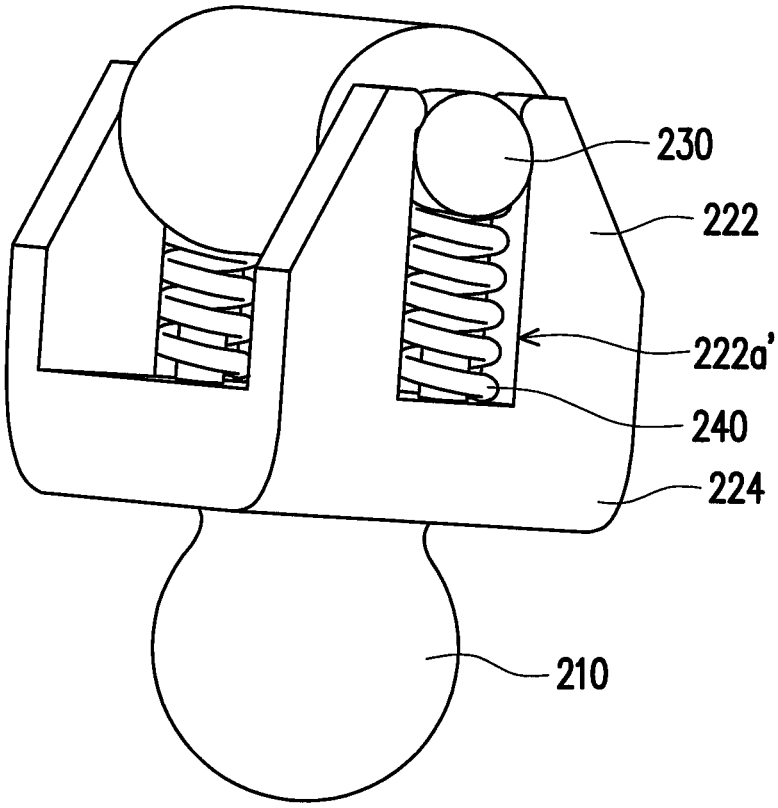
FIG. 8 is a schematic view of a driven roller unit according to the second embodiment of the present invention.

FIG. 8 is a schematic view of a driven roller unit according to the second embodiment of the present invention. Referring to FIG. 8, the assembling structures 222*a*' of the embodiment pass through the sidewalls 222 and the assembling structures 222*a*' are disposed to reach the openings of the base 224 along the altitudinal direction of the sidewalls 222. And a pair of elastomers 240, for example springs, are disposed in the openings, and the driven roller 230 props against on the two elastomers 240. Through the configuration of the elastomers 240, the crimp between the driving roller 320 and the driven roller 230 can be properly fit.

Figure 9:
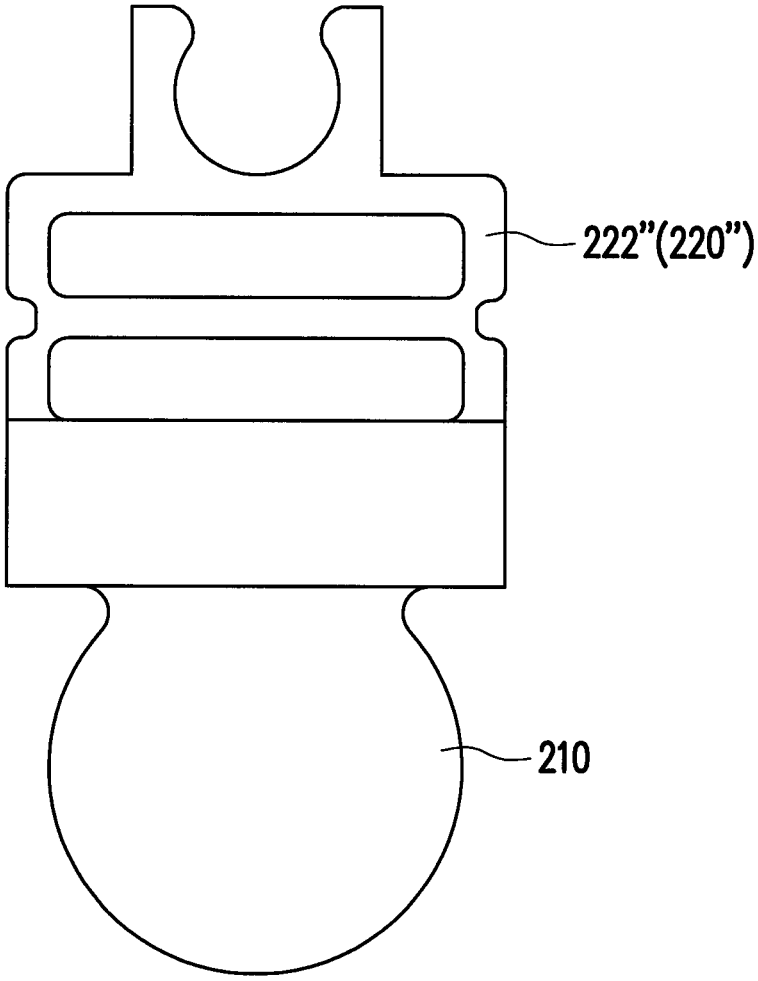
FIG. 9 is a schematic view of a driven roller unit according to the third embodiment of the present invention.

FIG. 9 is a schematic view of a driven roller unit according to the third embodiment of the present invention. Referring to FIG. 9, in the embodiment, a portion of each of the sidewalls 222" of the fixing support 220" is disposed hollow to form an elastic structure, and the driven roller 230 (shown in FIG. 3) is disposed on the elastic structure. Through the configuration of the elastic structure, the crimp between the driving roller 320 (shown in FIG. 4) and the driven roller 230 (shown in FIG. 2) can be properly fit.

Figure 10:
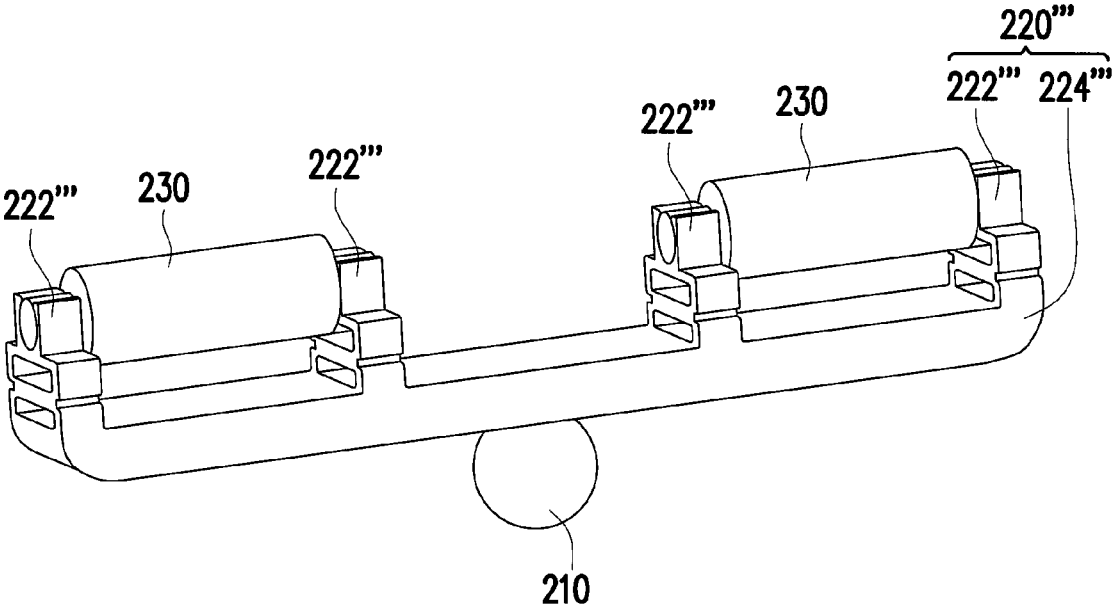
FIG. 10 is a schematic view of a driven roller unit according to the fourth embodiment of the present invention.

FIG. 10 is a schematic view of a driven roller unit according to the fourth embodiment of the present invention. Referring to FIG. 10 in the embodiment, the fixing support 220''' has two pairs of sidewalls 222", and two driven rollers 230 are included, and each of the driven rollers 230 is respectively disposed corresponding to a pair of sidewalls 222'''. The omnidirectional ball 210 is disposed at the center of the bottom of the base 224 of the fixing support 220. According to the embodiment, the number of the sidewalls 222''' and the driven rollers 230 is not limited and can be adjusted as required.

In light of the foregoing, since the driven roller unit of the present invention has the omnidirectional ball, when the applied force exerting on the driven roller is uneven, the omnidirectional ball rotates so that the axis of the driven roller can be parallel to the axis of the driving roller to balance the applied force exerting on the driven roller. The driven roller unit can be applied in a paper feeding device. And through the simple mechanism, the driven roller unit can self-calibrate relative to the driving roller, and the accuracy of paper feeding can be improved to prevent the paper skew problem. And the quality of the paper feeding device of the multi-function printer using the driven roller unit can be further improved.

Though the disclosure has been disclosed above by the embodiments, they are not intended to limit the disclosure. Persons skilled in the art may make some modifications and variations without departing from the spirit and scope of the disclosure. Therefore, the protecting range of the disclosure falls in the appended claims.

What is claimed is:

1. A driven roller unit, comprising:

a fixing support;

a ball disposed below the fixing support and integrally formed with the fixing support, wherein the fixing support further has a pair of sidewalls and a base connected between the pair of sidewalls, the ball is connected to a bottom of the base, each of the sidewalls has at least one hollow portion, so as to form an elastic structure; and a driven roller disposed on the fixing support, wherein when a force is exerted on the driven roller, the ball rotates to balance the force exerting on the driven roller unit.

2. The driven roller unit as claimed in claim 1, wherein the driven roller has an assembling shaft passing through the pair of sidewalls of the fixing support.

3. The driven roller unit as claimed in claim 2, wherein each of the sidewalls has an assembling structure, and the assembling shaft passes through the assembling structures.

4. The driven roller unit as claimed in claim 3, wherein the assembling structures are openings disposed on the sidewalls along an altitudinal direction thereof.

5. The driven roller unit as claimed in claim 4, further comprising a pair of elastomers disposed within the openings.

6. The driven roller unit as claimed in claim 1, wherein the driven roller has an assembling shaft passing through the fixing support.

7. A paper feeding device, comprising:

a frame having a dome concave;

a driven roller unit comprising:

a fixing support disposed in the frame, comprising:

a pair of sidewalls; and a base connected between the pair of sidewalls, wherein each of the sidewalls has at least one hollow portion, so as to form an elastic structure;

a ball, disposed below the fixing support and integrally formed with the fixing support, wherein the ball is located in the dome concave and connected to a bottom of the base; and a driven roller disposed on the fixing support; and a driving roller disposed above the driven roller unit and the frame and adapted to exert a force on the driven roller unit.

8. The paper feeding device as claimed in claim 7, wherein the frame further has a recess, and the dome concave is disposed in the recess.

9. The paper feeding device as claimed in claim 7, wherein the driven roller has an assembling shaft passing through the pair of sidewalls of the fixing support.

10. The paper feeding device as claimed in claim 9, wherein each of the sidewalls has an assembling structure, and the assembling shaft passes through the assembling structures.

11. The paper feeding device as claimed in claim 10, wherein the assembling structures are openings disposed on the sidewalls along an altitudinal direction thereof.

12. The paper feeding device as claimed in claim 11, further comprising a pair of elastomers disposed within the openings.

13. The paper feeding device as claimed in claim 7, wherein the driven roller has an assembling shaft passing through the fixing support.

* * * * *